US005685551A

United States Patent [19]

Zorzi et al.

[11] Patent Number: 5,685,551

[45] Date of Patent: Nov. 11, 1997

[54] ROLLER SKATE WITH IMPROVED PERFORMANCE

[75] Inventors: Claudio Zorzi, Paderno Di Ponzano Veneto; Roberto Gorza, Feltre, both of Italy

[73] Assignee: Nordica S.p.A., Trevignano, Italy

[21] Appl. No.: 462,944

[22] Filed: Jun. 5, 1995

[30] Foreign Application Priority Data

Jun. 13, 1994 [IT] Italy ..... TV94A0069

[51] Int. Cl.[6] ..... A63C 17/04

[52] U.S. Cl. ..... 280/11.22; 280/11.28

[58] Field of Search ..... 280/11.19, 11.22, 280/11.27, 11.28, 87.042

[56] References Cited

U.S. PATENT DOCUMENTS

| | | | |
|---|---|---|---|
| 4,909,523 | 3/1990 | Olson | 20/11.27 |
| 5,048,848 | 9/1991 | Olson et al. | 280/11.27 |
| 5,190,301 | 3/1993 | Malewicz | 280/11.27 |
| 5,374,072 | 12/1994 | Landers | 280/11.27 |
| 5,398,949 | 3/1995 | Tarng | 280/11.22 |
| 5,536,025 | 7/1996 | Landay | 280/11.27 |

FOREIGN PATENT DOCUMENTS 0486013 5/1992 European Pat. Off. .

*Primary Examiner*—Richard M. Camby

*Attorney, Agent, or Firm*—Guido Modiano; Albert Josif

[57] ABSTRACT

A roller skate with improved performance including a substantially U-shaped frame supporting in-line wheels. The skate comprises dampers that are adapted to absorb forces applied to the wheels and can be deactivated by tilting the frame.

19 Claims, 2 Drawing Sheets

ROLLER SKATE WITH IMPROVED PERFORMANCE

BACKGROUND OF THE INVENTION

The present invention relates to a roller skate with improved performance.

Conventional in-line skates comprise a shoe associated with a substantially U-shaped frame supporting a plurality of in-line wheels between the wings of the frame.

These conventional skates have a drawback that is due to the rigidity of the frame because the wheels transmit every force produced by the ground to the frame and therefore directly to the shoe, thus causing fatigue to the user's foot.

U.S. Pat. No. 2,552,987 discloses a roller skate that has a rigid support for a shoe, below which two pairs of arms are rotatably associated at one end; a wheel is rotatably associated between each one of said pairs of arms.

Each one of said pairs of arms can freely oscillate, at one end, in contrast with a flexible element that is interposed between said end and the lower surface of the rigid support for the shoe.

Although this solution allows to compensate for any unevennesses of the ground, it has the drawback that it performs this compensation or damping also when it is not required: in fact, during the pushing action, part of the force transmitted to the wheels is absorbed by the compression of the springs, and therefore there is a dispersion of forces that limits the efficiency during the pushing action.

Likewise, the drawback is felt when the user practices the sport of slalom, since every sudden change in direction is matched by a further compression of the springs; on one hand, this limits the sensitivity of the athlete, and on the other hand, it can cause unpleasant conditions in which the springs compress and elongate during slalom, leading to discordant movements during sports practice and consequently hindering the athlete's performance.

The springs are a drawback also in speed skating. They would in fact imbalance the athlete in that specific position he/she must assume in order to reach the maximum possible speed; this position usually entails bending the legs and lowering the trunk and is therefore not easy to maintain.

SUMMARY OF THE INVENTION

The aim of the present invention is to eliminate the technical problems and the drawbacks of the mentioned prior art by providing a skate that allows the user to compensate for the unevennesses of the ground surface and to optimally transmit forces during the pushing action.

Within the scope of the above aim, an important object is to provide a skate in which these two apparently contrasting characteristics can be achieved automatically without forcing the user to select them beforehand.

Another important object is to provide a skate that is structurally simple and is reliable and safe in use.

This aim, these objects, and others which will become apparent hereinafter are achieved by a roller skate with improved performance comprising a substantially U-shaped frame having wings supporting a plurality of aligned wheels therebetween, characterized in that it comprises damping means adapted to absorb forces applied to the wheels, said damping means being deactivated by tilting said frame.

BRIEF DESCRIPTION OF THE DRAWINGS

Further characteristics and advantages of the invention will become apparent from the detailed description of a particular but not exclusive embodiment, illustrated only by way of non-limitative example in the accompanying drawings, wherein.

DESCRIPTION OF THE PREFERRED EMBODIMENTS

Figure 1:
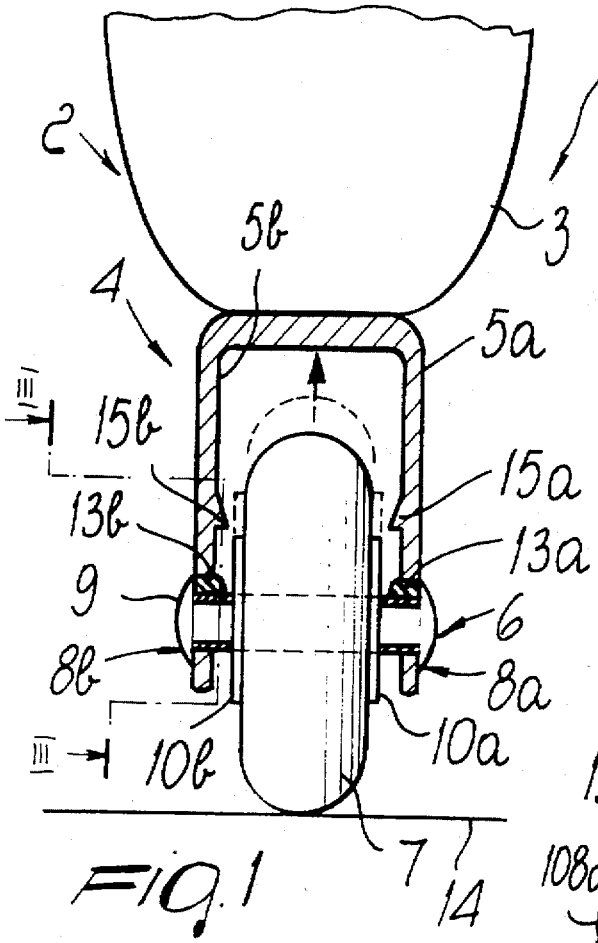
FIG. 1 is a cross-section view of the skate, according to the invention.

With reference to the above figures, the reference numeral 1 designates a skate comprising a shoe 2, which is constituted for example by a quarter that is articulated to a shell 3 and below which a substantially U-shaped frame 4 is associated.

A plurality of wheels 7 are associated between the wings 5*a* and 5*b* of the frame 4 and are thus mutually aligned.

Two spacers 8*a* and 8*b* are arranged coaxially to the axis of each pivot 6, at the wings 5*a* and 5*b*; said spacers are interposed between the head 9 of each pivot 6 and two shoulder rings 10*a* and 10*b* that are also coaxial to each pivot 6 and are associated at the hub and at the wheel.

Said two spacers 8*a* and 8*b* keep each wheel 7 arranged centrally with respect to the frame 4, so that the median longitudinal plane 11 of the frame 4 coincides with the median plane 12 of each wheel.

Said two spacers 8*a* and 8*b* are flexible and can optionally be interposed between the inside surfaces of the wings 5*a* and 5*b* of the frame 4 and said two rings 10*a* and 10*b*.

The skate comprises means that are adapted to absorb forces applied to the wheels 7; said means are constituted by two pads 13*a* and 13*b* that are arranged partially coaxially to the two spacers 8*a* and 8*b*, are associated with them on the opposite side with respect to the ground 14, partially affect an adapted seat formed on the wings 5*a* and 5*b*, and also protrude towards the facing two rings 10*a* and 10*b*.

Said pads 13*a* and 13*b* can be compressed elastically so as to allow, as shown in FIG. 1, damping of the wheels 7 if said wheels make contact with unevennesses of the ground The skate also comprises means that are adapted to deactivate said means adapted to absorb the forces applied to the wheels, when the frame 4 is tilted; said deactivation means are constituted by at least one protrusion that is located at each wheel and protrudes from at least one of the two inside lateral surfaces of the wings 5*a* and 5*b* of the frame 4; preferably, there are two protrusions 15*a* and 15*b* for each wheel, and said protrusions protrude from each one of the inside lateral surfaces of the wings 5*a* and 5*b*.

Said protrusions 15*a* and 15*b* protrude by such an extent that they do not affect, when the skate is used at right angles to the ground, the planes of arrangement of the two rings 10*a* and 10*b*, so as to allow their oscillation without mutual interaction.

Furthermore, the protrusions 15*a* and 15*b* are arranged slightly above the plane of arrangement that lies transversely to the wings 5*a* and 5*b* and passes through the upper end of the two rings 10*a* and 10*b* in the condition in which the skate is arranged approximately at right angles to the ground and when the ground is even.

Figure 2:
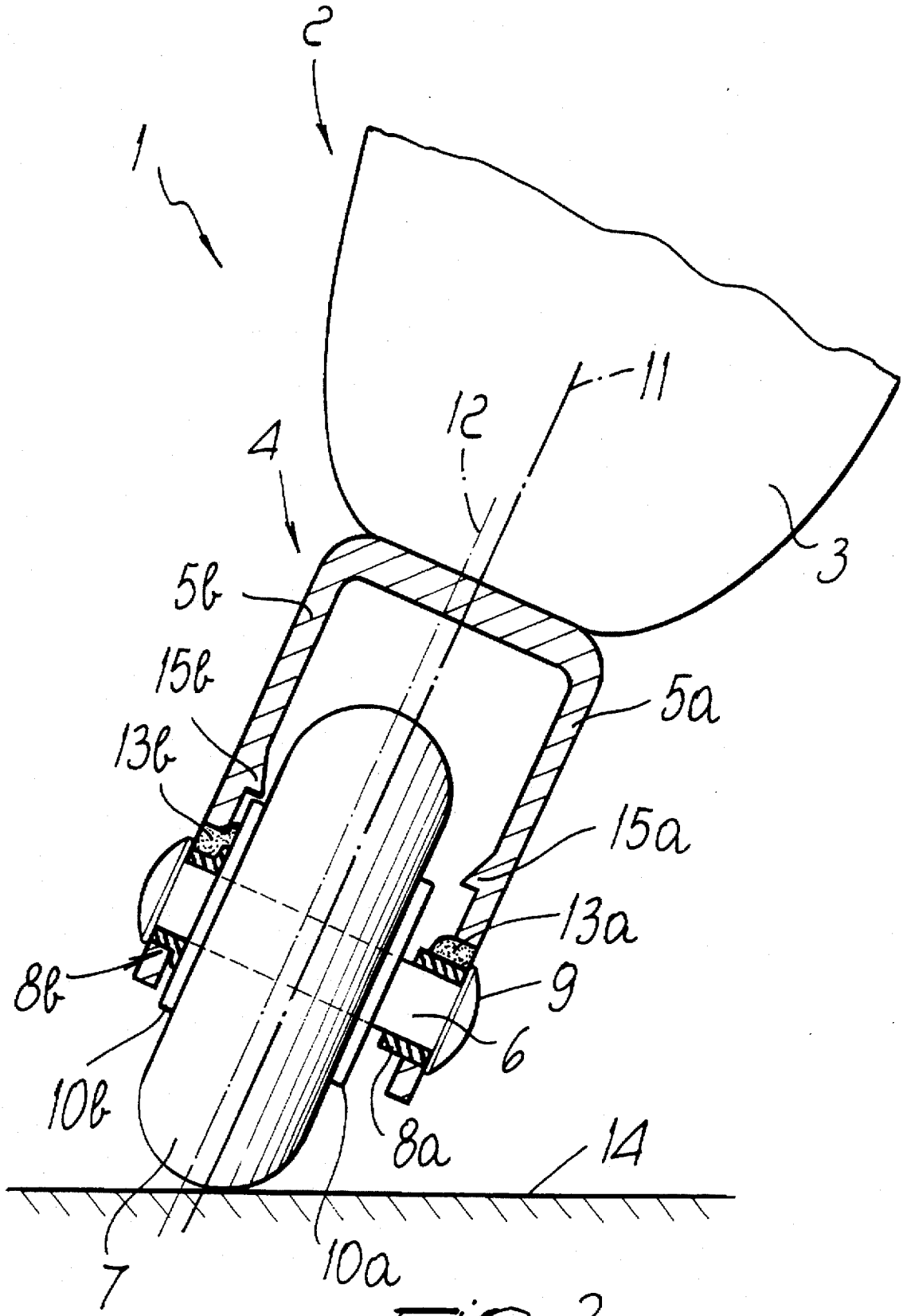
FIG. 2 is a view, similar to the preceding one, of the skate in the condition in which the user is pushing.

If the user tilts the frame 4 with respect to the ground, for example when he needs to push, each wheel 7, due to the forces involved, tends to partially compress, as shown in FIG. 2, the spacer 8b and the pad 13b as a consequence of the shift of said wheel towards the wing 5b.

In this manner, the ring 10b is arranged below the protrusion 15b, preventing the compression of the pads 13a and 13b and thus preventing the damping of the wheel and therefore the shift of the pivots 6 transversely to the wings of the frame.

Figure 4:
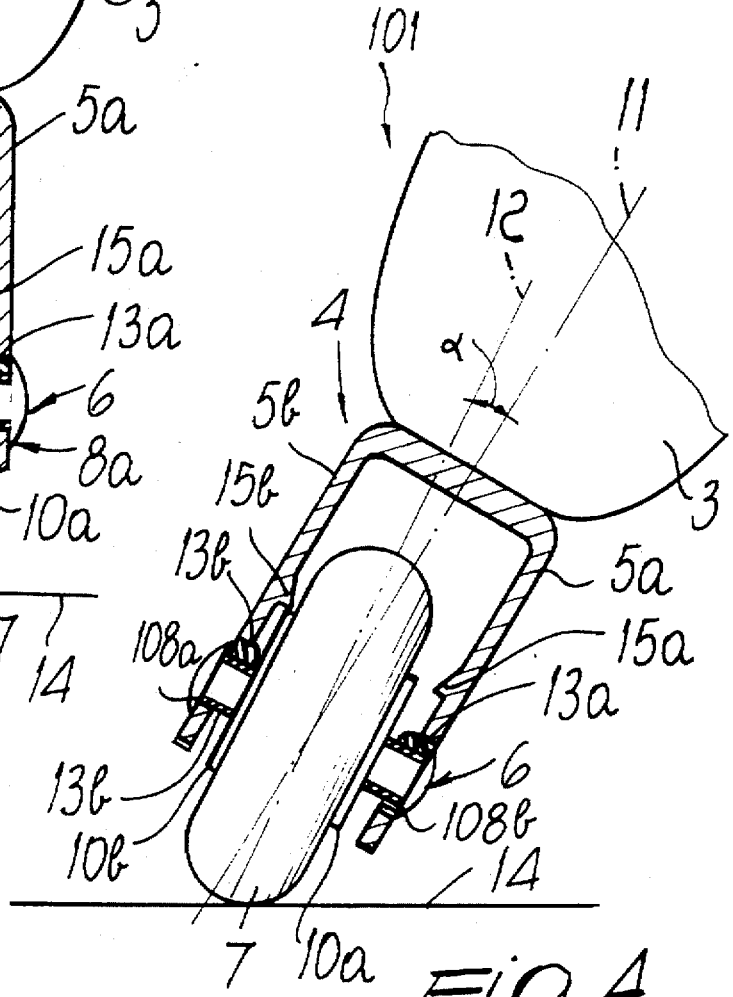
FIG. 4 is a view, similar to FIG. 2, of the skate, according to a second embodiment of the invention.
Figure 3:
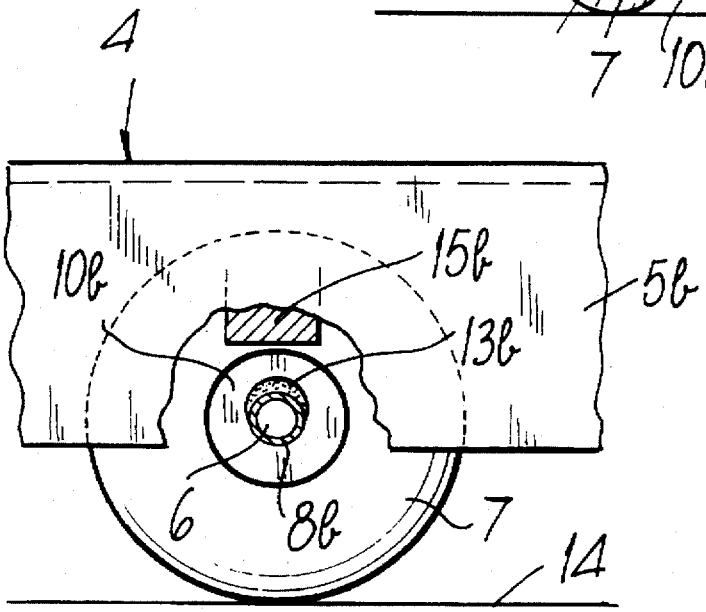
FIG. 3 is a sectional side view, taken along the plane III—III of FIG. 1.

FIG. 4 shows a second embodiment of the invention wherein like reference numerals denote similar features of FIGS. 1–3.

According to the second embodiment, skate 101 has flexible or compressible elements 108a, 108b having a different degree of resilience. In this manner the wheel 7 oscillate, as shown in FIG. 4, instead of shifting along the axis of the pivot 6, so as to cause for example a partial compression of the pad 13a with a consequent axial displacement between the median longitudinal plane 11 of the frame and the median plane 12 of the wheel 6, so as to form an angle $\alpha$ between them.

In any case, even in this condition the edge of the ring 10b interacts with the protrusion 15b, and therefore the forces are again transmitted directly from the foot to the wheel during the pushing action, without any further damping of said wheel between the wings of the frame 4.

It has thus been observed that the invention has achieved the intended aim and objects, a skate having been provided that allows both to optimally transmit the forces from the foot to the wheels during the pushing action and to compensate, during the other steps of skating, for any unevennesses in the ground, by virtue of the possibility of damping the impacts to which the wheels are subjected.

The skate according to the invention is of course susceptible of numerous modifications and variations, all of which are within the scope of the same inventive concept.

The dimensions and the materials that constitute the individual components of the structure may of course be the most pertinent according to the specific requirements.

What is claimed is:

1. Roller skate with improved performance, comprising:

a substantially U-shaped frame having wings supporting a plurality of aligned wheels therebetween;

damping means adapted to absorb forces applied to the wheels, said damping means being deactivated by tilting said frame; and deactivation means that are adapted to deactivate said damping means, when said frame is tilted, said deactivation means comprising at least one protrusion that protrudes from at least one of the two inside lateral surfaces of said wings of said frame.

2. Skate according to claim 1, further comprising for each wheel of said plurality of wheels:

a hub;

a pivot coaxial with said hub, said extending between said wings of said frame and having a pair of heads arranged respectively at outer sides of said wings for pivotally supporting said each wheel;

a pair of shoulder rings coaxial with said pivot and arranged respectively at outer sides of said each wheel; and two spacers arranged coaxially about said pivot each respectively at one of said wings of said frame, each of said spacers being interposed respectively between a respective one of said heads of said pivot and a respective one of said shoulder rings.

3. Skate according to claim 2, wherein said two spacers keep said each wheel central with respect to said frame, so that the median longitudinal plane of said frame coincides with the median plane of said each wheel.

4. Skate according to claim 3, wherein said two spacers are flexible and are interposed between the inside surfaces of said wings of said frame and said pair of rings.

5. Skate according to claim 3, wherein said damping means comprises pads arranged partially coaxially to said two spacers, on the opposite side with respect to the ground, said pads being at least partially arranged in adapted seats formed on said wings, and also protruding towards said facing two rings.

6. Skate according to claim 5, wherein said pads can be compressed elastically so as to allow to damp said wheels if they said wheels make contact with unevennesses of the ground.

7. Skate according to claim 1, wherein said at least one protrusion protrudes by such an extent as to not affect, when the skate is used at right angles to the ground, the planes of arrangement of said two rings, so as to allow said rings to oscillate freely without mutual interaction with said at least one protrusion.

8. Skate according to claim 7, wherein said at least one protrusion is positioned on a plane that lies transversely to said wings and slightly above the plane of arrangement that passes through the upper end of said pair of rings in the condition in which said skate is arranged approximately at right angles to smooth ground.

9. Skate according to claim 8, wherein when said frame is tilted with respect to the ground, each one of said wheels partially compresses one of said two spacers and the a corresponding one of said pads as a consequence of a translatory motion of said wheel towards one of said wings.

10. Skate according to claim 9, wherein as a consequence of said tilting one of said rings is arranged below a corresponding protrusion, preventing the compression of said pads, preventing the damping of said wheels, and preventing the translatory motion of said pivots transversely to said wings of said frame.

11. Skate according to claim 5, wherein said spacers have a different degrees of resilience allowing said pivot, when said frame is tilted with respect to the ground, to incline as a consequence of a partial compression of one of said pads, with a consequent axial displacement between said longitudinal median plane of said frame and said median plane of said wheel, so as to form an angle between said two planes.

12. Skate according to claim 11, wherein said axial displacement entails interaction between the edge of one of said two rings and one of said protrusions, preventing damping for said wheel.

13. Roller skate with improved performance, comprising:

a substantially U-shaped frame having wings supporting a plurality of aligned wheels therebetween; and damping means adapted to absorb forces applied to the wheels, said damping means being deactivated by tilting said frame;

wherein the skate further comprises for each wheel of said plurality of wheels:

a hub;

a pivot coaxial with said hub, said pivot extending between said wings of said frame and having a pair of heads arranged respectively at outer sides of said wings for pivotally supporting said each wheel;

a pair of shoulder rings coaxial with said pivot and arranged respectively at outer sides of said each wheel; and two spacers arranged coaxially about said pivot each respectively at one of said wings of said frame, each of said spacers being interposed respectively between a respective one of said heads of said pivot and a respective one of said shoulder rings, wherein said two spacers keep said each wheel central with respect to said frame, so that the median longitudinal plane of said frame coincides with the median plane of said each wheel; and wherein said damping means comprises pads arranged partially coaxially to said two spacers, on the opposite side with respect to the ground, said pads being at least partially arranged in adapted seats formed on said wings, and also protruding towards said facing two rings.

14. Skate according to claim 13, wherein said two spacers are flexible and are interposed between the inside surfaces of said wings of said frame and said pair of rings.

15. Skate according to claim 13, wherein said pads can be compressed elastically so as to allow to damp said wheels if said wheels make contact with unevennesses of the ground.

16. Skate according to claim 13, wherein said deactivation means are adapted to deactivate said damping means, when said frame is tilted, said deactivation means comprising at least one protrusion that protrudes from at least one of the two inside lateral surfaces of said wings of said frame.

17. Skate according to claim 13, wherein said at least one protrusion protrudes by such an extent as to not affect, when the skate is used at right angles to the ground, the planes of arrangement of said two rings, so as to allow said rings to oscillate freely without mutual interaction with said at least one protrusion, and wherein said at least one protrusion is positioned on a plane that lies transversely to said wings and slightly above the plane of arrangement that passes through the upper end of said pair of rings in the condition in which said skate is arranged approximately at right angles to smooth ground, and wherein when said frame is tilted with respect to the ground, each one of said wheels partially compresses one of said two spacers and a corresponding one of said pads as a consequence of a translatory motion of said wheel towards one of said wings, and wherein as a consequence of said tilting one of said rings is arranged below a corresponding protrusion, preventing the compression of said pads, preventing the damping of said wheels, and preventing the translatory motion of said pivots transversely to said wings of said frame.

18. Skate according to claim 13, wherein said spacers have a different degrees of resilience allowing said pivot, when said frame is tilted with respect to the ground, to incline as a consequence of a partial compression of one of said pads, with a consequent axial displacement between said longitudinal median plane of said frame and said median plane of said wheel, so as to form an angle between said two planes, and wherein said axial displacement entails interaction between the edge of one of said two rings and one of said protrusions, preventing damping for said wheel.

19. A roller skate with improved performance, comprising:

a substantially U-shaped frame having substantially vertical wings;

a plurality of aligned wheels rotatably supported between said wings of said frame;

for each wheel of said plurality of wheels, a rotatable connection for rotatably connecting said each wheel between said wings of said frame;

at least one elastic biasing element of said rotatable connection for permitting said each wheel to be displaced in a vertical direction with respect to said wings and for permitting said each wheel to be displaced also in a horizontal direction with respect to said wings; and at least one protrusion connected to at least one of said wings for engagement with at least one abutment connected in movement with said each wheel when said each wheel is displaced horizontally for blocking vertical displacement of said each wheel.

* * * * *